US006623621B1

(12) United States Patent
Iaccino et al.

(10) Patent No.: US 6,623,621 B1
(45) Date of Patent: Sep. 23, 2003

(54) CONTROL OF FLOODING IN A COUNTERCURRENT FLOW REACTOR BY USE OF TEMPERATURE OF LIQUID PRODUCT STREAM

(75) Inventors: Larry L. Iaccino, Friendswood, TX (US); Russell D. Sellen, Baytown, TX (US); David C. Dankworth, Whitehouse Station, NJ (US); Edward S. Ellis, Basking Ridge, NJ (US); Jeffrey W. Frederick, Morris Plains, NJ (US); Ramesh Gupta, Berkeley Heights, NJ (US); James J. Schorfheide, Baton Rouge, LA (US); Louis A. Curcio, Jr., Houston, TX (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/457,438

(22) Filed: Dec. 7, 1999

Related U.S. Application Data

(60) Provisional application No. 60/111,331, filed on Dec. 7, 1998.

(51) Int. Cl.[7] ..... C10G 45/00; C10G 65/02

(52) U.S. Cl. ..... 208/58; 208/59; 208/210; 208/213; 208/251 H; 208/254 H; 585/921

(58) Field of Search ..... 208/57, 58, 210, 208/213, 251 H, 254 H; 585/921

(56) References Cited

U.S. PATENT DOCUMENTS

| | | | | |
|---|---|---|---|---|
| 2,952,626 | A | 9/1960 | Kelley et al. | 208/210 |
| 2,971,754 | A | 2/1961 | Seyfried | 266/5 |
| 2,987,467 | A | 6/1961 | Keith et al. | 208/97 |
| 3,017,345 | A | 1/1962 | Eastman et al. | 208/210 |
| 3,091,586 | A | 5/1963 | Pappas et al. | 208/210 |
| 3,124,526 | A | 3/1964 | Butler et al. | 208/264 |
| 3,147,210 | A | 9/1964 | Hass et al. | 208/210 |
| 3,211,641 | A | 10/1965 | Halik et al. | 208/59 |
| 3,228,871 | A | 1/1966 | Schlinger et al. | 208/58 |
| 3,268,438 | A | 8/1966 | Scott, Jr. et al. | 208/89 |
| 3,413,216 | A | 11/1968 | Doumani | 208/216 |
| 3,415,737 | A | 12/1968 | Kluksdahl | 208/139 |
| 3,425,810 | A | 2/1969 | Scott, Jr. | 23/289 |
| 3,450,784 | A | 6/1969 | Reilly et al. | 260/667 |
| 3,461,063 | A | 8/1969 | Stine et al. | 208/143 |
| 3,595,779 | A | 7/1971 | Peck et al. | 208/210 |
| 3,607,723 | A | 9/1971 | Peck et al. | 208/59 |
| 3,658,681 | A | 4/1972 | Wilson et al. | 208/211 |
| 3,671,420 | A | 6/1972 | Wilson et al. | 208/61 |
| 3,673,078 | A | 6/1972 | Kirk, Jr. | 208/89 |
| 3,714,030 | A | 1/1973 | Winsor et al. | 208/210 |
| 3,767,562 | A | 10/1973 | Sze et al. | 208/57 |
| 3,775,291 | A | 11/1973 | Sze | 208/57 |
| 3,788,976 | A | 1/1974 | Kirk, Jr. | 208/89 |
| 3,843,508 | A | 10/1974 | Wilson et al. | 208/89 |
| 3,846,278 | A | 11/1974 | Sze et al. | 208/57 |
| 3,897,329 | A | 7/1975 | Franz et al. | 208/210 |
| 3,905,893 | A | 9/1975 | Christman et al. | 208/210 |
| 4,021,330 | A | 5/1977 | Satchell, Jr. | 208/89 |
| 4,022,682 | A | 5/1977 | Bludis et al. | 208/89 |
| 4,026,674 | A | 5/1977 | McDonald | 23/283 |
| 4,127,389 | A * | 11/1978 | Hackemesser et al. | 422/201 |
| 4,194,964 | A | 3/1980 | Chen et al. | 208/108 |
| 4,212,726 | A | 7/1980 | Mayes | 208/101 |
| 4,213,847 | A | 7/1980 | Chen et al. | 208/111 |
| 4,243,519 | A | 1/1981 | Schorfheide | 208/210 |
| 4,457,834 | A | 7/1984 | Caspers et al. | 208/143 |
| 4,476,069 | A | 10/1984 | Harper et al. | 261/97 |
| 4,526,757 | A | 7/1985 | Gupta | 422/106 |
| 4,591,426 | A | 5/1986 | Krasuk et al. | 208/96 |
| 4,599,162 | A | 7/1986 | Yen | 208/59 |
| 4,624,748 | A | 11/1986 | Haunschild | 203/29 |
| 4,755,281 | A | 7/1988 | Penick | 208/108 |
| 4,801,373 | A | 1/1989 | Corman et al. | 208/210 |
| 4,952,306 | A | 8/1990 | Sawyer et al. | 208/216 |
| 5,026,459 | A | 6/1991 | Quang et al. | 202/158 |
| 5,082,551 | A | 1/1992 | Reynolds et al. | 208/100 |
| 5,183,556 | A | 2/1993 | Reilly et al. | 208/57 |
| 5,252,198 | A | 10/1993 | Harrison et al. | 208/208 R |
| 5,262,044 | A | 11/1993 | Huizinga et al. | 208/107 |
| 5,292,428 | A | 3/1994 | Harrison et al. | 208/208 R |
| 5,348,641 | A | 9/1994 | Shih | 208/89 |
| 5,366,614 | A | 11/1994 | Russ et al. | 208/65 |
| 5,378,348 | A | 1/1995 | Davis et al. | 208/27 |
| 5,449,501 | A | 9/1995 | Luebke et al. | 422/193 |
| 5,518,607 | A | 5/1996 | Field et al. | 208/212 |
| 5,522,198 | A | 6/1996 | Byer et al. | 52/741.3 |
| 5,522,983 | A | 6/1996 | Cash et al. | 208/59 |
| 5,525,311 | A * | 6/1996 | Girod et al. | 422/200 |
| 5,670,116 | A | 9/1997 | Gupta et al. | 422/191 |
| 5,705,052 | A | 1/1998 | Gupta | 208/57 |
| 5,720,872 | A | 2/1998 | Gupta | 208/57 |
| 5,779,992 | A | 7/1998 | Higashi | 422/190 |
| 5,882,505 | A | 3/1999 | Wittenbrink et al. | 208/59 |
| 5,888,376 | A | 3/1999 | Wittenbrink et al. | 208/59 |
| 5,888,377 | A | 3/1999 | Bertram | 208/59 |
| 5,906,728 | A | 5/1999 | Iaccino et al. | 208/61 |
| 5,925,235 | A | 7/1999 | Habib | 208/111.35 |
| 5,939,031 | A | 8/1999 | Ellis et al. | 422/191 |
| 5,942,197 | A | 8/1999 | Gupta et al. | 422/191 |
| 5,985,131 | A * | 11/1999 | Gupta et al. | 208/57 |
| 6,007,787 | A | 12/1999 | Gupta et al. | 422/191 |
| 6,159,358 | A * | 12/2000 | Mulvaney, III et al. | 208/46 |
| 6,241,952 | B1 * | 6/2001 | Ellis et al. | 422/192 |

FOREIGN PATENT DOCUMENTS

| | | |
|---|---|---|
| DE | 2935191 A1 | 4/1981 |
| GB | 1323257 | 7/1973 |
| RU | 2016617 | 7/1994 |

* cited by examiner

*Primary Examiner*—Walter D. Griffin
(74) *Attorney, Agent, or Firm*—Gerard J. Hughes; Jeremy J. Kliebert

(57) ABSTRACT

A process for upgrading a liquid petroleum or chemical stream wherein said stream flows countercurrent to the flow of a treat gas, such as a hydrogen-containing gas, in at least one reaction zone. The temperature of at least a portion of the liquid stream in the reactor is used to control the flooding characteristics of the reactor.

8 Claims, No Drawings

CONTROL OF FLOODING IN A COUNTERCURRENT FLOW REACTOR BY USE OF TEMPERATURE OF LIQUID PRODUCT STREAM

This application claims the benefit of Provisional Application No. 60/111,331 filed on Dec. 7, 1998.

BACKGROUND OF THE DISCLOSURE

1. Field of the Invention

The present invention relates to a process for upgrading a liquid petroleum or chemical stream wherein said stream flows countercurrent to the flow of a treat gas, such as a hydrogen-containing gas, in at least one reaction zone. The temperature of at least a portion of the liquid stream in the reactor is used to control the flooding characteristics of the reactor.

2. Background of the Invention

There is a continuing need in the petroleum refining and chemical industries for improved catalysts and process technology. One such process technology, hydroprocessing, has been subjected to increasing demands for improved heteroatom removal, aromatic saturation, and boiling point reduction. More active catalysts and improved reaction vessel designs are needed to meet this demand. Countercurrent reaction vessels have the potential of helping to meet these demands because they offer certain advantages over co-current flow reactors. Countercurrent hydroprocessing is well known, but of very limited commercial use. A countercurrent process is disclosed in U.S. Pat. No. 3,147,210 that teaches a two-stage process for the hydroprocessing-hydrogenation of high boiling aromatic hydrocarbons. The feedstock is first subjected to catalytic hydroprocessing, preferably in co-current flow with hydrogen. It is then subjected to hydrogenation over a sulfur-sensitive noble metal hydrogenation catalyst countercurrent to the flow of a hydrogen-rich gas. U.S. Pat. Nos. 3,767,562 and 3,775,291 disclose a similar process for producing jet fuels, except the jet fuel is first hydrodesulfurized prior to two-stage hydrogenation. U.S. Pat. No. 5,183,556 also discloses a two-stage concurrent-countercurrent process for hydrofining-hydrogenating aromatics in a diesel fuel stream.

While the concept of countercurrent hydroprocessing has been known for some time, countercurrent flow reaction vessels are typically not used in the petroleum industry, primarily because conventional countercurrent reaction vessels are susceptible to catalyst bed flooding. That is, the relatively high velocity of the upflowing treat gas prevents the downward flow of the liquid. The liquid thus cannot pass through the catalyst bed. While flooding is undesirable, catalyst contacting by the reactant liquid improves as the bed approaches a flooded condition. However, operating close to the point of incipient flooding leaves the process vulnerable to fluctuations in pressure or temperature or in liquid or gas flow rates. This could result in a disturbance large enough to initiate flooding, and process unit shutdown in order to recover stable operation. Such disruptions are highly undesirable in a continuous commercial operation.

In a countercurrent flow reactor temperature gradients are produced: axial, radial, and localized hot spots. Axial temperature gradients cause refluxing which decreases the kinetic efficiency of the reactor and can make the reactor hydraulically inoperable. All of the temperature gradients contribute to the potential for reactor runaway, decreased reaction selectivity, and less than optimum kinetic/thermodynamic performance. The potential for runaway is particularly important as it restricts the usage of catalysts systems such as those that promote hydrocracking. Conventional temperature control—quench (gas or liquid) and inter bed heat exchange—does not fully solve these problems Therefore, there still exists a need for improved countercurrent process designs to improve on the flooding characteristics, as well as other aspects of the process.

SUMMARY OF THE INVENTION

In accordance with the present invention there is provided a process for hydroprocessing a hydrocarbonaceous feedstream, which process comprises:

(a) introducing said feedstream into a reaction vessel upstream from at least one reaction zone and passing said feedstream through one or more reaction zones operated at hydroprocessing, wherein each reaction zone contains a bed of hydroprocessing catalyst;

(b) introducing a hydrogen-containing treat gas at the bottom of said reaction vessel and passing it upward through each reaction zone countercurrent to the flow of liquid feedstream, thereby reacting with said feedstream in the presence of said hydroprocessing catalysts and resulting in a liquid phase product stream and a vapor phase product stream;

(c) passing the liquid phase product out of the bottom of said reaction vessels;

(d) removing the vapor phase product stream overhead of said reaction zones; and (e) controlling the temperature of the reaction vessel with one or more heat exchange devices either internal or external of said reaction vessel.

In a preferred embodiment the temperature of the reaction vessel is controlled with one or more heat exchange devices internal of said reaction vessel, which one or more heat exchange devices are selected from:

i) reaction zones that are vertically situated tubes, said tubes containing said hydroprocessing catalyst through which said feedstrean flows countercurrent to the treat gas and wherein a heat exchange media is circulated on the outer surfaces of said tubes;

ii) vertically situated tubes containing heat exchange media with said hydroprocessing catalyst being external to said tubes; and iii) one or more reaction zones being divided into vertical sections with catalyst being situated in alternating sections and heat exchange media in the remaining sections.

In another preferred embodiment of the present invention the reaction vessel is controlled so that the entire reaction vessel is operated under substantially isothermal conditions.

In still another preferred embodiment at least a portion of the heat exchange media used in the heat exchange device is all or a portion of the hydrocarbonaceous feedstream.

In yet another preferred embodiment the temperature profile of the reaction vessel is controlled so that the temperature decreases as the hydrocarbon liquid proceeds down the reaction vessel.

DETAILED DESCRIPTION OF THE INVENTION

Non-limiting examples of hydroprocessing processes which can be practiced by the present invention include the hydroconversion of heavy petroleum feedstocks to lower boiling products; the hydrocracking of distillate boiling range feedstocks; the hydrotreating of various petroleum feedstocks to remove heteroatoms, such as sulfur, nitrogen, and oxygen; the hydrogenation of aromatics; the hydroisomerization and/or catalytic dewaxing of waxes, particularly Fischer-Tropsch waxes; and demetallation of heavy streams. It is preferred that the reaction vessels used in the practice of the present invention be those in which a hydrocarbon feedstock is hydrotreated and hydrogenated, more specifically when heteroatoms are removed and when at least a portion of the aromatic fraction of the feed is hydrogenated.

The practice of the present invention is applicable to all liquid-vapor countercurrent refinery and chemical processes. Feedstocks suitable for use in the practice of the present invention include those ranging from the naphtha boiling range to heavy feedstocks, such as gas oils and resids. Typically, the boiling range will be from about 40° C. to about 1000° C. Non-limiting examples of such heavy feedstocks include vacuum resid, atmospheric resid, vacuum gas oil (VGO), atmospheric gas oil (AGO), heavy atmospheric gas oil (HAGO), steam cracked gas oil (SCGO), deasphalted oil (DAO), and light cat cycle oil (LCCO).

The feedstocks of the present invention are subjected to countercurrent hydroprocessing in at least one catalyst bed, or reaction zone, wherein feedstock flows countercurrent to the flow of a hydrogen-containing treat gas. Typically, the hydroprocessing unit used in the practice of the present invention will be comprised of one or more reaction zones wherein each reaction zone contains a suitable catalyst for the intended reaction and wherein each reaction zone is immediately preceded and followed by a non-reaction zone where products can be removed and/or feed or treat gas introduced. The non-reaction zone will typically be a void (with respect to catalyst) horizontal cross section of the reaction vessel of suitable height, although it may contain inert packing material.

If the feedstock contains unacceptably high levels of heteroatoms, such as sulfur, nitrogen, or oxygen moieties, it can first be subjected to hydrotreating. In such cases, it is preferred that the first reaction zone be one in which the liquid feed stream flows co-current with a stream of hydrogen-containing treat gas through a fixed-bed of suitable hydrotreating catalyst. Of course the hydrotreating can be done in a separate reaction vessel. The term "hydrotreating" as used herein refers to processes wherein a hydrogen-containing treat gas is used in the presence of a catalyst that is primarily active for the removal of heteroatoms, including some metals removal, with some hydrogenation activity. When the feedstock is a Fischer-Tropsch reaction product stream, the most troublesome heteroatom species are the oxygenates.

Suitable hydrotreating catalysts for use in the present invention are any conventional hydrotreating catalyst and includes those which are comprised of at least one Group VIII metal, preferably Fe, Co and Ni, more preferably Co and/or Ni, and most preferably Ni; and at least one Group VI metal, preferably Mo and W, more preferably Mo, on a high surface area support material, preferably alumina. Other suitable hydrotreating catalysts include zeolitic catalysts, as well as noble metal catalysts where the noble metal is selected from Pd and Pt. It is within the scope of the present invention that more than one type of hydrotreating catalyst be used in the same bed. The Group VIII metal is typically present in an amount ranging from about 2 to 20 wt. %, preferably from about 4 to 12%. The Group VI metal will typically be present in an amount ranging from about 5 to 50 wt. %, preferably from about 10 to 40 wt. %, and more preferably from about 20 to 30 wt. %. All metals weight percents are on support. By "on support" we mean that the percents are based on the weight of the support. For example, if the support were to weigh 100 g. then 20 wt. % Group VIII metal would mean that 20 g. of Group VIII metal was on the support. Typical hydroprocessing temperatures will be from about 100° C. to about 450° C. at pressures from about 50 psig to about 2,000 psig, or higher. If the feedstock contains relatively low levels of heteroatoms, then the co-current hydrotreating step can be eliminated and the feedstock can be passed directly to the hydroisomerization zone.

It will be understood that the treat-gas need not be pure hydrogen, but can be any suitable hydrogen-containing treat-gas. It is preferred that the countercurrent flowing treat gas be cold make-up hydrogen-containing treat gas, preferably hydrogen. The countercurrent contacting of the liquid effluent with cold hydrogen-containing treat gas serves to effect a high hydrogen partial pressure and a cooler operating temperature, both of which are favorable for shifting chemical equilibrium towards saturated compounds. The liquid phase will typically be a mixture of the higher boiling components of the fresh feed. The vapor phase in the catalyst bed of the downstream reaction zone will be swept upward with the upflowing hydrogen-containing treat-gas and collected, fractionated, or passed along for further processing. It is preferred that the vapor phase effluent be removed from the non-reaction zone immediate upstream (relative to the flow of liquid effluent) of the countercurrent reaction zone.

Very often temperature control will be required for a countercurrent flow reactor due to the heat release associated with the exothermic reactions conducted in the reactor. This temperature control would typically be achieved by addition of a cooler fluid, either gas or liquid. Previously, it had been thought that the liquid quench would need to be a stream with very low heteroatom content so that heteroatoms were not introduced deep into the reactor where it was desirous to have a low heteroatom environment. The use of this liquid quench is expensive because it requires additional equipment; increases the liquid loading in the reactor resulting in a larger reactor diameter and larger down stream equipment; and it does not remove any heat from the system merely dilutes the heat so that additional heat removal is still required.

Improved temperature control can be achieved by withdrawing the down flowing liquid from the countercurrent flow reactor, cooling it in a conventional heat exchanger, and reintroducing it to the bed below. Similarly, the up flowing vapor phase can be withdrawn, cooled, and reintroduced to the bed above. Cooling of the vapor stream cannot achieve as much heat removal from the reactor due to the lower thermal capacity of the vapor stream. Cooling of the vapor stream does as much heat removal from the reactor due to the lower thermal capacity of the vapor stream. Cooling of the vapor stream does however have an additional benefit of allowing the condensation of vaporized hydrocarbon and its optional removal from the system so as to reduce hydraulic loading in the countercurrent reactor. In some cases it will be desirable to cool both the liquid and vapor streams. The removal and reintroduction can be done using any collectors and distributors known to those skilled in the art of tray design. If only one of the streams—liquid or vapor—are being cooled, equipment may be required to balance pressure drop on the stream not being cooled. The use of this invention is particularly desirable when a large temperature adjustment is required (i.e., for a large temperature adjustment between a heteroatom removal step and an aromatics saturation step.

Also, improved temperature control can be achieved by placing one or more heat exchange devices (i.e., coil) in the reactor and circulating a cooling media through the device. The heat exchange device may be contained within a catalyst bed, in the vapor space between catalyst beds, or submerged in the liquid on redistributor trays. Applying the invention by cooling the liquid on the distributor trays is the more preferred route as this the way that ensures uniform radial temperature. The heat removal media may be selected from the group consisting of: water, preferably steam; feed with the additional benefit of preheating the feed to reaction temperature without investment in additional heat exchange area and heat source; and other media familiar to those skilled in the art. The use of the instant invention is particularly desirable when a large temperature adjustment is required (i.e., for a large temperature adjustment between a heteroatom removal step and an aromatics saturation step).

The present invention would be of use for the full range of feeds currently envisioned for countercurrent hydroprocessing technology. The countercurrent reactor may be one of only countercurrent flow, or it can be a split flow reactor (countercurrent flow with a co-current vapor phase reaction zone above the feed point). The present invention can also be coupled with other temperature control mechanisms.

If the vapor phase effluent still contains an undesirable level of heteroatoms, it can be passed to a vapor phase reaction zone containing additional hydrotreating catalyst and subjected to suitable hydrotreating conditions for further removal of the heteroatoms. It is to be understood that all reaction zones can either be in the same vessel separated by non-reaction zones, or any can be in separate vessels. The non-reaction zones in the later case will typically be the transfer lines leading from one vessel to another. It is also within the scope of the present invention that a feedstock that already contains adequately low levels of heteroatoms fed directly into a countercurrent hydroprocessing reaction zone. If a preprocessing step is performed to reduce the level of heteroatoms, the vapor and liquid are disengaged and the liquid effluent directed to the top of a countercurrent reactor. The vapor from the preprocessing step can be processed separately or combined with the vapor phase product from the countercurrent reactor. The vapor phase product(s) may undergo further vapor phase hydroprocessing if greater reduction in heteroatom and aromatic species is desired or sent directly to a recovery system. The catalyst may be contained in one or more beds in one vessel or multiple vessels. Various hardware, i.e., distributors, baffles, heat transfer devices may be required inside the vessel(s) to provide proper temperature control and contacting (hydraulic regime) between the liquid, vapors, and catalyst. Also, cascading and liquid or gas quenching may also be used in the practice of the present, all of which are well known to those having ordinary skill in the art.

In another embodiment of the present invention, the feedstock can be introduced into a first reaction zone co-current to the flow of hydrogen-containing treat-gas. The vapor phase effluent fraction is separated from the liquid phase effluent fraction between reaction zones; that is, in a non-reaction zone. This separation between reaction zones is also referred to as catalytic distillation. The vapor phase effluent can be passed to additional hydrotreating, or collected, or further fractionated and sent to additional processing. The liquid phase effluent will then be passed to the next downstream reaction zone, which will preferably be a hydroisomerization countercurrent reaction zone. In other embodiments of the present invention, vapor or liquid phase effluent and/or treat gas can be withdrawn or injected between any reaction zones.

The countercurrent contacting of an effluent stream from an upstream reaction zone, with hydrogen-containing treat gas, strips dissolved heteroatom impurities from the effluent stream, thereby improving both the hydrogen partial pressure and the catalyst performance. That is, the catalyst may be on-stream for substantially longer periods of time before regeneration is required. The process of the present invention will achieve further, higher heteroatom removal levels.

What is claimed is:

1. A process for hydro processing a hydrocarbonaceous feedstream, which process comprises:

(a) introducing said feedstream into a reaction vessel upstream from at least one reaction zone and passing said feedstream through one or more reaction zones operated at hydroprocessing conditions, wherein each reaction zone contains a bed of hydroprocessing catalyst;

introducing a hydrogen-containing treat gas at the bottom of said reaction vessel and passing it upward through at least one reaction zone countercurrent to the flow of liquid feedstream, thereby reacting with said feedstream in the presence of said hydroprocessing catalysts and resulting in a liquid phase product stream and a vapor phase product stream;

(c) passing the liquid phase product out of the bottom of said reaction vessel;

(d) removing the vapor phase product stream overhead of said reaction zones; and (e) controlling the temperature of the reaction vessel with one or more heat exchange devices internal of said reaction vessel, which one or more heat exchange devices are selected from:

i) reaction zones that are vertically situated tubes, said tubes containing said hydroprocessing catalyst through which said feedstream flows countercurrent to the treat gas and wherein a heat exchange media is circulated on the outer surfaces of said tubes;

ii) vertically situated tubes containing heat exchange media with said hydroprocessing catalyst being external to said tubes; and iii) one or more reaction zones being divided into vertical sections with catalyst being situated in alternating sections and heat exchange media in the remaining sections.

2. The process of claim 1 wherein at least one heat exchange device is located within one or more catalyst beds of said reaction vessel.

3. The process of claim 1 wherein the temperature of the reaction vessel is controlled so that the entire reaction vessel is operated under substantially isothermal conditions.

4. The process of claim 1 wherein at least a portion of the heat exchange media used in the heat exchange device is all or a portion of the hydrocarbonaceous feedstream.

5. The process of claim 1 wherein the temperature profile of the reaction vessel is controlled so that the temperature decreases as the hydrocarbon liquid proceeds down the reaction vessel.

6. The process of claim 1 wherein the hydrocarbonaceous feedstream is a heavy feedstock selected from the group consisting of vacuum resid, atmospheric resid, vacuum gas oil, atmospheric gas oil, heavy atmospheric gas oil, steam cracked gas oil, desaphalted oil, and light cat cycle oil.

7. The process of claim 1 wherein the hydrocarbonaceous feedstock is a naphtha boiling range feedstock.

8. The process of claim 1 wherein the feedstock is a Fischer-Tropsch reactor product stream.

* * * * *